United States Patent [19]

Hickey

[11] 4,028,853

[45] June 14, 1977

[54] SEALING TOGETHER OF FLEXIBLE SHEETS

[76] Inventor: Christopher Daniel Dowling Hickey, 5 Heathside, Hinchley Wood, Esher, Surrey, England

[22] Filed: June 16, 1976

[21] Appl. No.: 696,721

[30] Foreign Application Priority Data

July 17, 1975 United Kingdom ..... 30087/75

[52] U.S. Cl. ..... 52/2; 52/741

[51] Int. Cl.[2] ..... E04B 1/34

[58] Field of Search ..... 52/2, 741; 150/52 K, 150/52 R; 24/DIG. 26

[56] References Cited

UNITED STATES PATENTS

| | | | |
|---|---|---|---|
| 3,816,885 | 6/1974 | Saether | 52/2 X |
| 3,929,178 | 12/1975 | Hickey | 150/52 K |

FOREIGN PATENTS OR APPLICATIONS

| | | | |
|---|---|---|---|
| 1,286,544 | 8/1972 | United Kingdom | 52/2 |

*Primary Examiner*—Ernest R. Purser
*Assistant Examiner*—Carl D. Friedman
*Attorney, Agent, or Firm*—Young & Thompson

[57] ABSTRACT

A flexible seal is formed between the peripheral portions of two flexible sheets by providing an inflatable tube, the peripheral portions being rolled up with the tube, secured in the rolled position and the tube inflated to form a tight seal. Preferably each sheet is provided with a flap integral with or secured to the sheet, these flaps facilitating tight securing of the roll.

16 Claims, 6 Drawing Figures

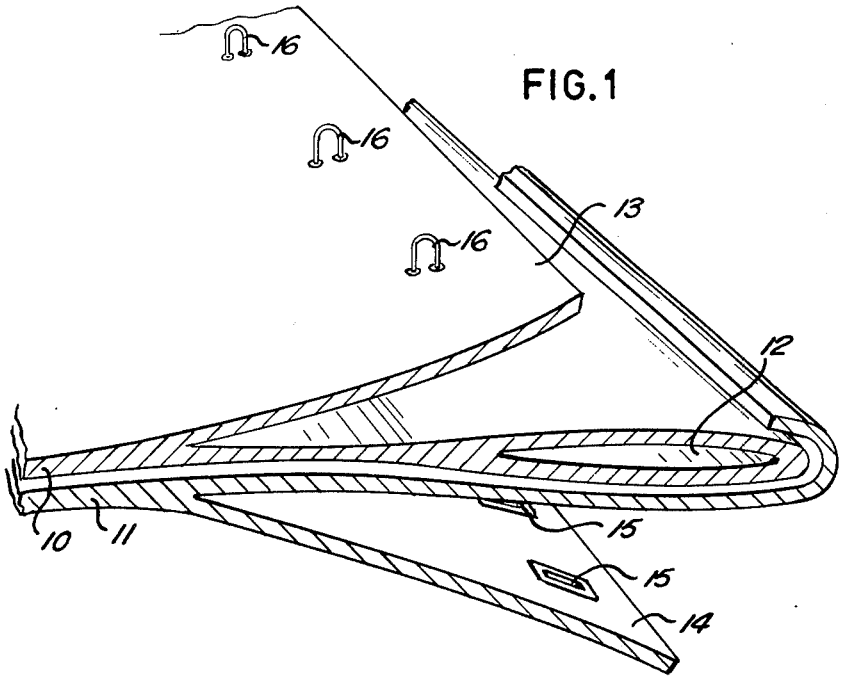
FIG. 1
FIG. 2
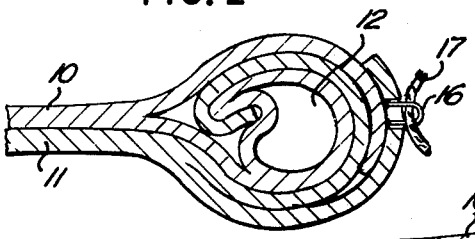
FIG. 4
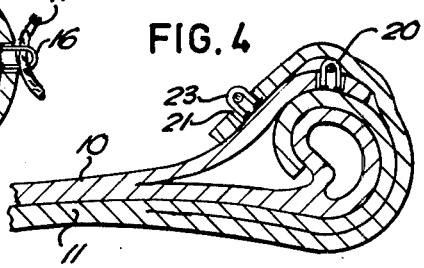
FIG. 6
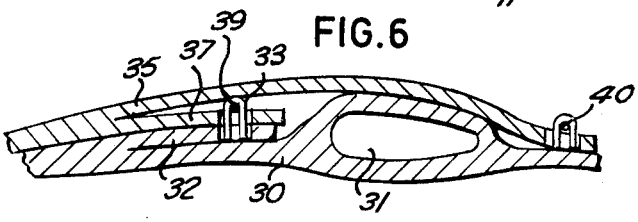

SEALING TOGETHER OF FLEXIBLE SHEETS

BACKGROUND OF THE INVENTION

1. Field of the Invention

This invention relates to the sealing together of the peripheral portions of two flexible sheets.

2. Description of the Prior Art

Sealing together of two flexible sheets is required, for example, in the forming of airtight containers using flexible covers. Such containers are used for the storage of goods; the use of a flexible cover is particularly advantageous if the container is partially evacuated of air so that the flexible sheet or sheets collapse around the goods in the container thereby holding them securely in place. As an example of such a container, reference may be made to U.S. Pat. No. 3,929,178. Heretofore however, the sealing together of two sheets to form an airtight seal has required either continuous welding along the length of the seal or the provision of a rigid sealing system. Continuous welding is not wholly reliable because any gap in the welding will cause an air leak. For that reason, it has heretofore been preferred to effect sealing by putting the peripheries of the two sheets together in a slot or groove formed in a rigid member extending around the periphery. A tight seal can be obtained then by inflating a flexible tube in the slot or groove to force the peripheral portions of the sheets into tight contact. Such an arrangement is disclosed for example in the aforementioned U.S. Pat. No. 3,929,178. It results however in a rigid structure of predetermined dimensions irrespective of the size of the goods within the container.

SUMMARY OF THE INVENTION

It is an object of the present invention to provide a seal between two flexible sheets enabling their peripheries to be sealed together in an airtight manner yet in which the seal remains flexible. This permits a sealed container to be formed using flexible sheets in which the container need not have any predetermined dimensions but can closely conform to the goods within the container.

According to one aspect of the invention, a method of sealing together peripheral portions of two flexible sheets comprises the steps of putting together the peripheral portions of the two sheets in overlying relationship together with an inflatable tube extending along the length of said peripheral portions, securing the peripheral portions in this position and then inflating the tube.

Conveniently the peripheral portions are secured by means of flaps on the two sheets, the flaps having means whereby they can readily be secured to one another. The inflatable tube may be integral with or carried on one of the flaps or one of the sheets or it may be separate tube, in which case the securing means, e.g. the flaps, are arranged to hold the tube adjacent the peripheral portion of one or both sheets to extend along the length thereof.

The invention furthermore includes within its scope a method of sealing together peripheral portions of two flexible sheets, one of said portions having an inflatable tube therein or thereon extending along the whole length thereof comprising the steps of forming the peripheral portions of the sheets into a roll having an axis parallel to the axis of the tube, the two sheets being rolled together, securing the roll to prevent it unwinding and then inflating the tube. By rolling together the two peripheral portions forming in effect a "swiss" roll containing the inflatable tube, and then securing this roll against unwinding, it becomes possible to obtain a tight seal when the tube is inflated. The securing of the roll against unwinding is conveniently effected by means of flaps attached to or integral with the sheets, the roll being formed between the two flaps which can then be secured together in any convenient manner. It will be immediately apparent that, by using two flaps in this way, the flaps themselves need not be airtight and may have holes for lacing or securing in any other way yet it is possible to make an airtight seal provided the sheets are formed of impervious material.

According to another aspect of the invention, there is provided a flexible seal between peripheral portions of two flexible sheets wherein each sheet, along the length to be sealed, has a flexible flap overlying at least part of the peripheral portion of the sheet and wherein one of the sheets has an inflatable tube forming part of or extending along the peripheral portion of the sheet to be sealed, means being provided for securing the two flaps together to hold the peripheral portions of the sheets in a roll so that, by rolling the peripheral portions together and then inflating said tube, a tight seal may be effected between said peripheral portions. By using impervious sheet material, an airtight seal may be obtained in this way. The tube may be integral with or secured to the peripheral portion of one of the sheets. It will be appreciated that, to obtain an airtight seal, the roll must be such that impervious portions of the two sheets are tightly forced together on inflating the tube. The flaps may be integral with the sheets or may be secured thereto. These flaps however need not be of impermeable material although very conveniently they may be made of the same material as the remainder of the sheet. A fluid inlet pipe, conveniently with a suitable valve may be provided extending through one of the flaps for inflating the tube. Conveniently air or other gas is used for inflating the tube.

For securing the two flaps together, conveniently U-shaped pins are provided on one of the flaps with the ends of the arm of the U attached to the flap so that each pin with the sheet forms a closed loop and the other flap is formed with slots to receive the U-shaped pins so that the two flaps may be secured together by putting the slots over the U-shaped pins and then passing a cord through the apertures formed by the pins.

BRIEF DESCRIPTION OF THE DRAWINGS

FIG. 1 is a perspective diagram showing the part of the peripheral portion of two sheets with the sealing means;

FIG. 2 is a section through a seal between portions of two sheets of the form shown in FIG. 1;

FIGS. 3 and 4 are views similar to FIGS. 1 and 2 respectively illustrating a further form of construction and FIGS. 5 and 6 are views similar to FIGS. 1 and 2 respectively and illustrating yet another form of construction.

DESCRIPTION OF THE PREFERRED EMBODIEMENTS

Figure 3:
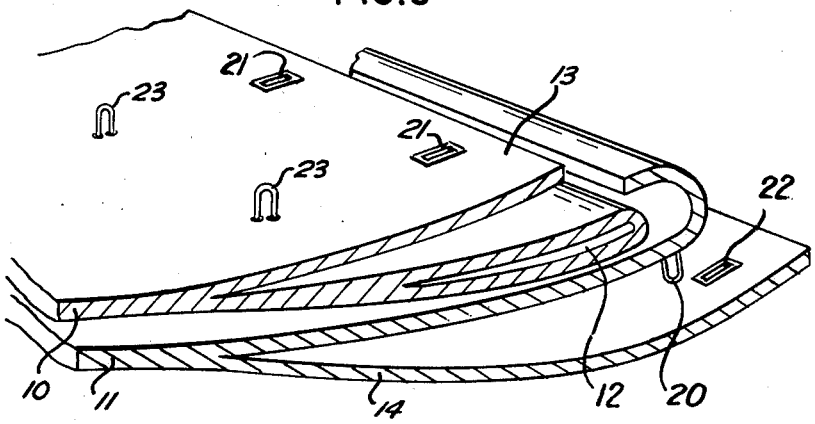

Referring to FIGS. 1 and 2 there is shown a form of seal construction for sealing together a length of the peripheral portions of two flexible impermeable sheets 10, 11. The seal might extend around the whole periphery of the sheets or along only part thereof as necessary depending on the circumstances in which the seal is used. The sheet 10 along the peripheral portion to be sealed is formed with an integral tubular portion 12 which is inflatable. Conveniently for this purpose, the tube 12 may be provided with an inlet pipe having a non-return valve, conveniently arranged at the end of the tube. The sheet 10 also has a flap 13 which, in this embodiment, extends along the whole length of the peripheral portion to be sealed. The flap 13 is shown as being formed integrally with the sheet 10 but this is not necessary so long as the flap is firmly attached to the sheet. The flap 13 itself need not be made of impermeable material although generally it is convenient to make it of the same material as the sheet 10. The other sheet 11 also has a similar flap 14. The flaps 13, 14, when the sheets are extended, overlie the peripheral portions of the sheeet though, as in the embodiment illustrated, they need not extend up as far as the edge of the main portion of the sheet. The two sheets 10, 11 are placed together with the flaps on the outer sides as shown in FIG. 1. To seal the two sheets together, the peripheral portions of each of the two sheets extending outwardly from the junctions of the flaps are rolled up together to form a swiss roll as shown in FIG. 2 and then the two flaps are secured together to prevent the roll unwinding. In the embodiment illustrated, flap 14 is provided with slots 15 through which pass U-shaped pins 16 on the flap 13. A cord 17 is then laced through the loops formed by the portions of the pins passing through the slots. Then the tube 12 is inflated. This inflation of the tube causes the peripheral portions of the sheets to be tightly sealed to one another.

FIGS. 3 and 4 illustrate a modification of the construction of FIGS. 1 and 2. In the following description reference will be made only to the distinctive features of FIGS. 3 and 4. In this arrangement, when the peripheral portion of the two sheets have been rolled together, the roll is firstly secured to the flap 13 by passing U-shaped pins 20 on the peripheral portion of sheet 11 through slots 21 in the flap 13. A cord is passed through the pins to secure them and then the assembly is further rolled so that slots 22 in the flap 14 can be passed over further U-shaped pins 23 on the flap 13 thereby ensuring that the assembly is held securely against any possibility of the sheets coming apart.

Figure 5:
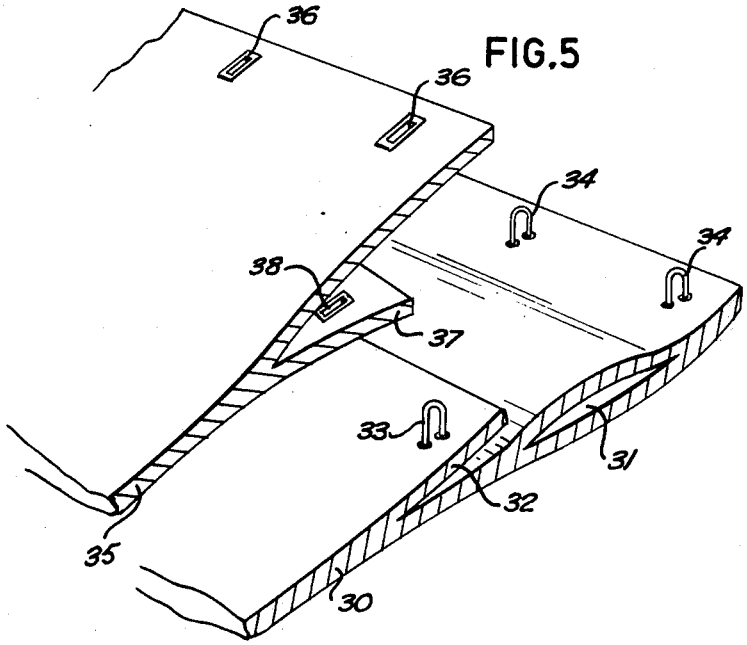

In the construction shown in FIGS. 5 and 6, a flexible impermeable sheet 30 has an integral inflatable tube 31 extending parallel to and adjacent the edge of the sheet in the region to be joined. This sheet 30 has an integral flap 32 with U-shaped pins 33. Further U-shaped pins 34 are provided along the length of sheet 30 near the edge thereof. The second sheet 35 has slots 36 near the edge of the sheet to receive pins 34. Sheet 35 also has an integral flap 37 with slots 38. In this construction, the sheets 30, 35 are put together with their flaps 32, 37 between them. The flaps are secured together by slots 38 and pins using a cord 39 through the pins. The outer peripheral edges are then secured using pins 34 and slots 36, using a cord 40 through the pins and the tube 31 is then inflated so as to ensure that the sheets are tightly pressed against one another.

Although in the above-described embodiments, an inflatable tube integral with one of the sheets has been described, in some cases, it may be preferred to use a separate tube. This may for example, be secured by lacing between the sheets and then inflated so as to bear tightly against both the sheets and so form an air-tight seal between these sheets.

A flexible seal as described above may be used for example to form a container of two, or possibly more, sheets of flexible material, for example plastics material. There may be, for example, a lower sheet on which the article or articles to be stored are placed and an upper sheet which is then put over the article or articles and sealed to the lower sheet as described above. The assembly may then be inflated, for example with compressed dry air or an inert gas or it may be partially evacuated so that the flexible sheets collapse down on the article or articles between them and so hold them tightly.

I claim:

1. A method of sealing together peripheral portions of two flexible sheets comprising the steps of putting together the peripheral portions of the two sheets in overlying relationship together with an inflatable tube extending along the whole length of said peripheral portions, securing the peripheral portions in this position and then inflating the tube.

2. A method as claimed in claim 1 wherein said peripheral portions are secured by means of flaps on the two sheets, the flaps having means whereby they can readily be secured to one another.

3. A method as claimed in claim 1 wherein the inflatable tube is integral with one of the flaps.

4. A method as claimed in claim 1 wherein the inflatable tube is integral with one of the sheets.

5. A method as claimed in claim 1 wherein the inflatable tube is a separate tube and wherein said securing means hold that tube adjacent said peripheral portion of at least one sheet to extend along the whole length thereof.

6. A method of sealing together peripheral portions of two flexible sheets, one of said portions having an inflatable tube extending along the whole length thereof comprising the steps of forming the peripheral portions of the sheets into a roll having an axis parallel to the axis of the tube, the two sheets being rolled together, securing the roll to prevent it unwinding and then inflating the tube.

7. A method as claimed in claim 6 wherein the roll is secured against unwinding by means of flaps attached to or integral with the sheets, the roll being formed between the two flaps which are then secured together.

8. A flexible seal between peripheral portions of two flexible sheets wherein each sheet, along the length to be sealed, has a flexible flap overlying at least part of the peripheral portion of the sheet and wherein one of the sheets has an inflatable tube along the peripheral portion of the sheet to be sealed, means being provided for securing the two flaps together to hold the peripheral portions of the sheets in a roll so that, by rolling the peripheral portions together and then inflating said tube, a tight seal may be effected between said peripheral portions.

9. A flexible seal as claimed in claim 8 wherein said inflatable tube forms part of the said peripheral portion of said one of the sheets.

10. A flexible seal as claimed in claim 9 wherein the tube is secured to the peripheral portion of one of the sheets.

11. A flexible seal as claimed in claim 8 wherein the sheets are of impervious material.

12. A flexible seal as claimed in claim 11 wherein the tube is integral with the peripheral portion of one of the sheets.

13. A flexible seal as claimed in claim 8 wherein said flaps are integral with the sheets.

14. A flexible seal as claimed in claim 8 wherein said flaps are secured to said sheets.

15. A flexible seal as claimed in claim 8 wherein a fluid inlet pipe is provided extending through one of the flaps for inflating the tube.

16. A flexible seal as claimed in claim 8 wherein, for securing the two flaps together, U-shaped pins are provided on one of the flaps with the ends of the arms of the U attached to the flap so that each pin with the sheet forms a closed loop and wherein the other flap is formed with slots to receive the U-shaped pins so that the two flaps are securable together by putting the slots over the U-shaped pins and wherein a cord is provided passing through the apertures formed by the pins.

* * * * *